US009162246B2

(12) United States Patent
Nagata et al.

(10) Patent No.: US 9,162,246 B2
(45) Date of Patent: Oct. 20, 2015

(54) COATING LIQUID FILLING METHOD, SLIT NOZZLE, DISCHARGE OUTLET CLOSING MEMBER, AND SLIT NOZZLE UNIT

(71) Applicant: HIRATA CORPORATION, Shinagawa-ku (JP)

(72) Inventors: Yoshihisa Nagata, Shinagawa-ku (JP); Osamu Udo, Shinagawa-ku (JP)

(73) Assignee: HIRATA CORPORATION, Shinagawa-Ku, Tokyo (JP)

( * ) Notice: Subject to any disclaimer, the term of this patent is extended or adjusted under 35 U.S.C. 154(b) by 0 days.

(21) Appl. No.: 14/076,614

(22) Filed: Nov. 11, 2013

(65) Prior Publication Data

US 2014/0131464 A1 May 15, 2014

(30) Foreign Application Priority Data

Nov. 11, 2012 (JP) ..... 2012-247968

(51) Int. Cl.
*B05C 1/02* (2006.01)
*B05B 15/02* (2006.01)
*B05D 1/30* (2006.01)

(52) U.S. Cl.
CPC *B05C 1/027* (2013.01); *B05B 15/02* (2013.01)

(58) Field of Classification Search
CPC ..... B05C 1/027; B05C 1/025; B05C 1/16; B05C 5/0212; B05C 5/0216; B05C 5/022; B05C 5/0254; B05C 5/0283; B05D 1/305
USPC ..... 239/1, 11, 597; 118/313–315, 410–413, 118/429; 427/356, 358, 407.1, 407.2
See application file for complete search history.

(56) References Cited

U.S. PATENT DOCUMENTS

| | | | | |
|---|---|---|---|---|
| 3,938,468 | A * | 2/1976 | Kirschner | 118/63 |
| 4,938,994 | A * | 7/1990 | Choinski | 427/96.1 |
| 5,622,747 | A * | 4/1997 | Todd et al. | 438/759 |
| 7,083,826 | B2 * | 8/2006 | Pekurovsky et al. | 427/356 |
| 2003/0183167 | A1 * | 10/2003 | Kitazawa et al. | 118/323 |
| 2006/0283535 | A1 * | 12/2006 | Jeong | 156/60 |
| 2012/0024989 | A1 * | 2/2012 | Kouketsu et al. | 239/601 |
| 2013/0025535 | A1 * | 1/2013 | Choi et al. | 118/302 |

FOREIGN PATENT DOCUMENTS

| | | | |
|---|---|---|---|
| JP | H09-276771 | A | 10/1997 |
| JP | 2005-144376 | A | 6/2005 |
| JP | 4040144 | B2 | 1/2008 |
| TW | 200507947 | A | 3/2005 |

* cited by examiner

*Primary Examiner* — Len Tran
*Assistant Examiner* — Cody Lieuwen
(74) *Attorney, Agent, or Firm* — Buchanan Ingersoll & Rooney PC

(57) ABSTRACT

A filling method exhausts gas from inside a slit nozzle that applies coating liquid onto a substrate surface while filling the slit nozzle with the coating liquid. The slit nozzle includes a coating liquid supply opening, a coating liquid discharge outlet, a manifold that is connected to the supply opening and holds the coating liquid inside the slit nozzle, a liquid channel that is connected to the manifold and supplies the coating liquid to the discharge outlet of the slit nozzle, and a ventilation hole for exhausting gas from inside the manifold. The filling method includes: a discharge outlet closing process that closes the discharge outlet while the coating liquid is being fed from the supply opening into the slit nozzle; and a ventilation hole opening process that opens the ventilation hole.

9 Claims, 9 Drawing Sheets

COATING LIQUID FILLING METHOD, SLIT NOZZLE, DISCHARGE OUTLET CLOSING MEMBER, AND SLIT NOZZLE UNIT

FIELD OF THE INVENTION

The present invention relates to a slit nozzle that discharges a coating liquid to form a coated film, a coating liquid filling method for such slit nozzle, a discharge outlet closing member used when filling with such coating liquid, and a slit nozzle unit including such discharge outlet closing member.

DESCRIPTION OF THE RELATED ART

Slit coating carried out using a slit nozzle is one method of forming a coating film on the surface of a glass substrate for a liquid crystal display, a semiconductor wafer, or the like. Such method forms a coated layer by discharging a coating liquid, which fills a manifold inside the slit nozzle, from a slit-shaped discharge outlet of the slit nozzle.

As the apparatus that forms a coated layer with a method such as slit coating, an apparatus capable of forming a high-quality coated layer, such as a coating layer of a uniform thickness, is desirable.

One example of an apparatus that carries out slit coating is a coating processing apparatus equipped with a slit nozzle with an air-bleeding hole that removes air from inside the manifold (see Patent Document 1).

The slit nozzle of such apparatus is equipped with supply openings formed in both side ends of the manifold and an air-bleeding hole formed in an upper center of the manifold, and when resist solution is supplied into the manifold from both supply openings, air is bled out from the central air-bleeding hole so that the manifold becomes filled with the resist solution. Also, the upper surface of the manifold of such apparatus is formed so as to be inclined with rising slopes from the supply holes at both ends toward the lower end of the air-bleeding hole at the upper center. By forming the manifold in the shape described above, it is possible to easily and reliably remove air inside the manifold and moreover possible to obtain a uniform coated layer that does not include air bubbles. This means that by opening the air-bleeding hole for a certain period before the start of the coating process to remove gas from inside the manifold while filling the manifold with the coating liquid, the pressure of the coating liquid discharged from the discharge outlet can be regulated so as to be uniform and the coating process will start after the coating liquid to be discharged from the discharge outlet has been arranged into a straight line.

Patent Document 1

Japanese Laid-Open Patent Publication No. 2005-144376 (see FIG. 3 and Paragraph [0072])

SUMMARY OF THE INVENTION

However, a slit nozzle 100 is equipped with a liquid channel 102 that joins the coating liquid to the discharge outlet below a manifold 101 (see FIG. 7). In this slit nozzle 100, the coating liquid L flows from the manifold 101 via the liquid channel 102 to the discharge outlet 103 at the front end of the nozzle. When forming a thin coated layer with a coating liquid with low viscosity, the width of the liquid channel 102 will be around several tens of micrometers and the coating liquid L will spread out as far as the corners of the manifold 101 before the liquid reaches the discharge outlet 103, making it possible to bleed air out from inside the manifold 101 without any problems.

However, as the viscosity of the coating liquid L increases, higher pressure and more time become necessary as the pressure and time for extruding the liquid, and the width of the liquid channel 102 of the slit nozzle 100 also needs to be increased.

When the width of the liquid channel is increased, there is a tendency for the coating liquid L to reach the discharge outlet 103 at an earlier time, so that the coating liquid may spill out from the discharge outlet 103 before the coating liquid has spread out to the corners of the manifold 101 (i.e., before the manifold has become filled with the coating liquid) (see FIG. 7).

The present invention was conceived in view of the problems described above and has an object of providing a coating liquid filling method capable of favorably carrying out the bleeding of air at a slit nozzle with a wide slit for use with highly-viscose liquids, and to also provide a discharge outlet closing member used in such a slit nozzle and a slit nozzle unit.

A coating liquid filling method that fills an inside of a slit nozzle, which applies coating liquid with a predetermined width onto a surface of a processed object, with the coating liquid, wherein the slit nozzle includes a supply opening that is a supply portion for the coating liquid, a discharge outlet that is a discharge portion for the coating liquid, a manifold that is connected to the supply opening and holds the coating liquid inside the slit nozzle, a liquid channel that is connected to the manifold and supplies the coating liquid toward the discharge outlet of the slit nozzle, and a ventilation hole for exhausting gas from inside the manifold, the coating liquid filling method comprising: a discharge outlet closing process that closes the discharge outlet; and a ventilation hole opening process that opens the ventilation hole, the discharge outlet closing process and the ventilation hole opening process being carried out while the coating liquid is being fed from the supply opening into the slit nozzle.

The feeding process that feeds the coating liquid into the slit nozzle may be a process where filling of the manifold with the coating liquid is completed after filling the liquid channel with the coating liquid.

The discharge outlet closing process may be carried out before filling the liquid channel with the coating liquid is commenced.

The slit nozzle may have a plurality of ventilation holes, the respective ventilation holes may be opened and closed by the ventilation hole opening process and a ventilation hole closing process that are carried out for each ventilation hole, and opening and closing of the ventilation holes may be controlled so that at least one of the ventilation holes is open.

The coating liquid filling method may further include: a process that opens the discharge outlet that is in a closed state after an end of the feeding process that feeds the coating liquid into the slit nozzle; and a process that subsequently scrapes away coating liquid that has come out of the discharge outlet.

The discharge outlet closing process may be a process that closes the discharge outlet by placing a discharge outlet closing member in contact with the discharge outlet, and the process that opens the discharge outlet that is in the closed state may be a process that separates the discharge outlet closing member from the discharge outlet.

Another aspect of the present invention is the discharge outlet closing member used in the coating liquid filling method described above.

Yet another aspect of the present invention is a slit nozzle unit including a slit nozzle that applies a coating liquid onto a surface of a processed object with a predetermined width, wherein the slit nozzle includes a supply opening that is a supply portion for the coating liquid, a discharge outlet that is a discharge portion for the coating liquid, a manifold that is connected to the supply opening and holds the coating liquid inside the slit nozzle, a liquid channel that is connected to the manifold and supplies the coating liquid toward the discharge outlet of the slit nozzle, and a ventilation hole for exhausting gas from inside the manifold, and the slit nozzle unit further includes a discharge outlet closing member used to close the discharge outlet while the coating liquid is being fed from the supply opening into the slit nozzle.

Yet another aspect of the present invention is a slit nozzle unit including a slit nozzle that applies coating liquid with a predetermined width onto a surface of a processed object and the discharge outlet closing member described above.

The discharge outlet closing member may be constructed by covering a periphery of a core member, which is a main portion, with an elastic body.

The coating liquid applying method according to the present invention is capable of filling a manifold with coating liquid both quickly and reliably. The coating liquid applying method according to the present invention is also favorable as a coating liquid applying method for a slit nozzle with a wide slit. By filling with coating liquid using this method, it is possible in a subsequent coating process to more reliably form a coated layer with a uniform thickness. Also, by using the discharge outlet closing member and slit nozzle unit according to the present invention, it is possible to carry out the coating liquid filling method according to the present invention more reliably.

DESCRIPTION OF THE PREFERRED EMBODIMENTS

Next, embodiments of a coating liquid filling method, a slit nozzle, a discharge outlet closing member, and a slit nozzle unit according to the present invention will be described.

This coating liquid filling method is used when filling the slit nozzle provided in a liquid coating apparatus with coating liquid. For this reason, a liquid coating apparatus will be described first. The liquid coating apparatus is an apparatus for coating a plate material, such as a substrate, with a thin coated film (while leaving the edges uncoated).

Figure 1:
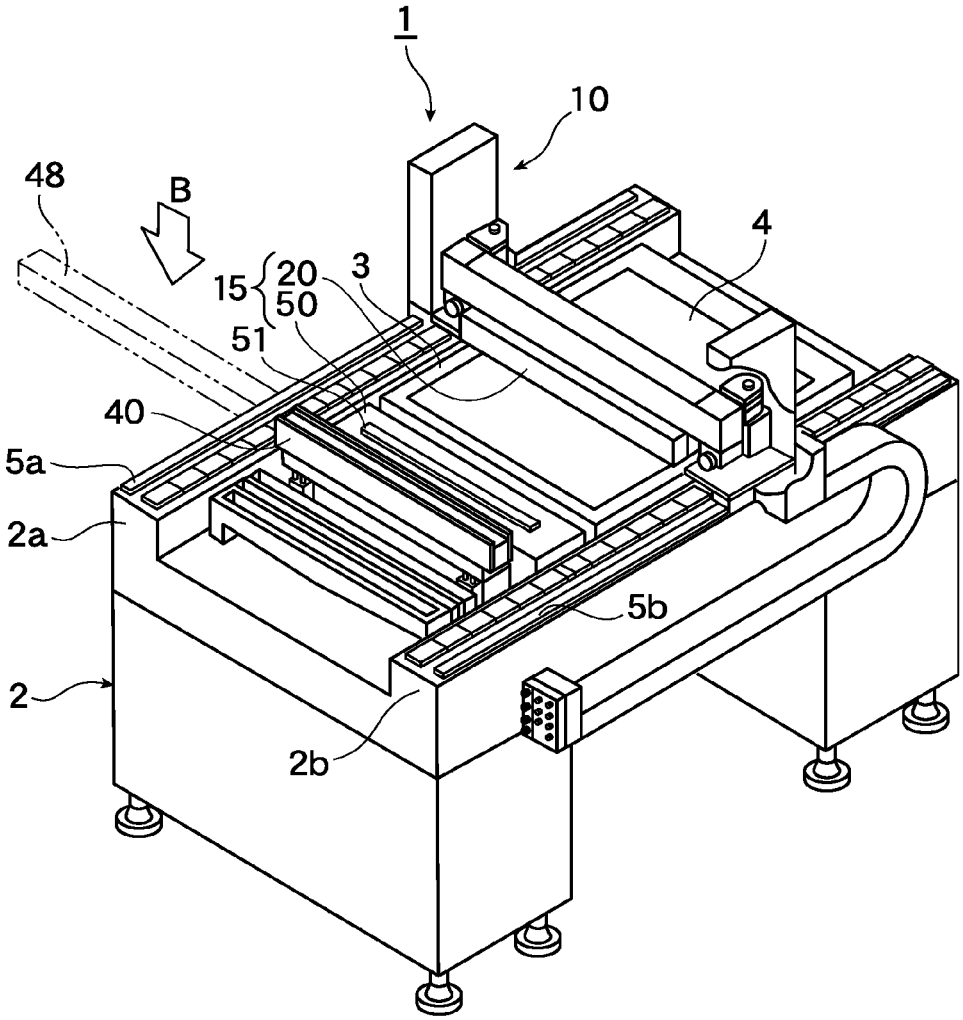
FIG. 1 is a perspective view showing a liquid coating apparatus to which a slit nozzle, which is filled with coating liquid by a coating liquid filling method according to the present invention, is attached.

As shown in FIG. 1, the liquid coating apparatus 1 is equipped with a base 2 and a table 3 for a plate material which is installed at a center portion on the base 2. Such table 3 is a table on which a plate material 4, which is the object to be coated (i.e., the "processed object"), is placed. Side walls 2*a*, 2*b* that are erected at right angles are respectively formed on both side edges of the base 2, and rails 5*a*, 5*b* are laid out on the upper surfaces of such side walls 2*a*, 2*b*. A coating mechanism unit 10 is installed so as to be capable of moving on such rails 5*a*, 5*b*.

A slit nozzle 20, with a discharge outlet 29 (see FIGS. 3 and 4) described later at the lower end thereof, is installed on the coating mechanism unit 10 so as to be capable of being raised and lowered. Accordingly, when coating liquid is applied onto the surface of the plate material 4 placed on the table 3, the coating mechanism unit 10 is moved and the coating liquid is discharged from the discharge outlet 29 at the lower end of the slit nozzle 20. By doing so, the coating liquid is applied with a predetermined width onto the surface of the plate material 4 to form a coated layer with a predetermined width.

Figure 8:
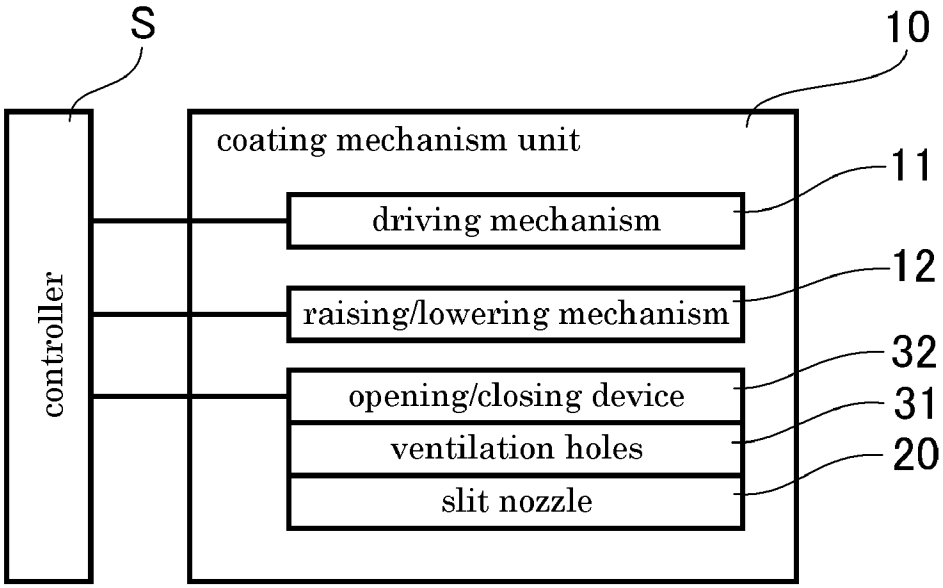
FIG. 8 is a block diagram showing a controller and objects being controlled.

Note that operations in the liquid coating apparatus, such as a driving operation of a driving mechanism 11 that drives the coating mechanism unit 10, a raising/lowering operation of a raising/lowering mechanism 12 that raises and lowers the slit nozzle 20, and an opening/closing operation of an opening/closing device 32 that opens and closes ventilation holes 31, described later, are controlled by a controller (control unit) S of the liquid coating apparatus (see FIG. 8). Since such controller S is a well-known device, detailed description thereof is omitted here.

Figure 2:
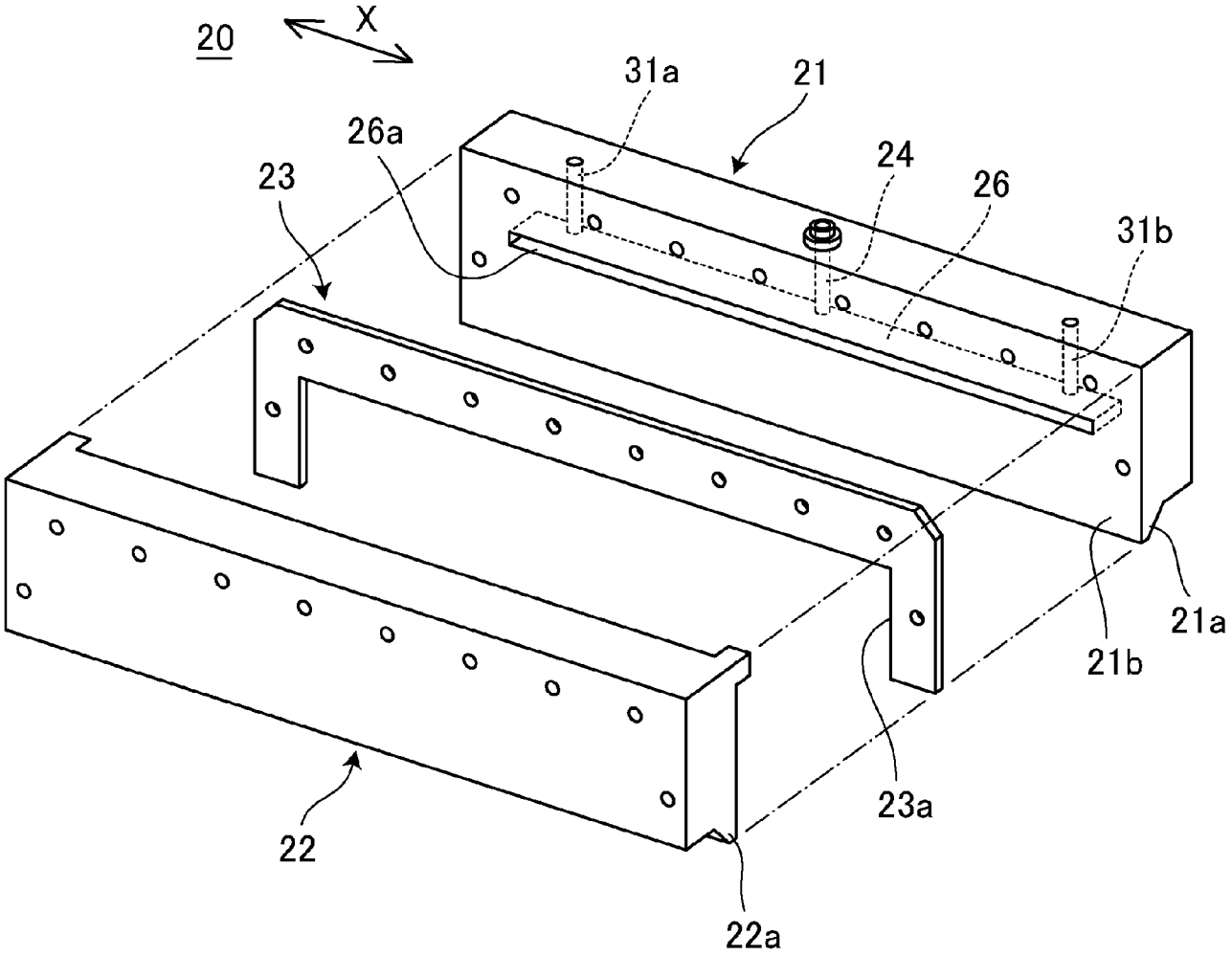
FIG. 2 is an exploded perspective view showing the slit nozzle.

The slit nozzle 20 can be detachably attached to the liquid coating apparatus 1 and, as shown in FIG. 2, is constructed from two nozzle pieces 21, 22 into which the nozzle is split and a shim 23 that is combined so as to be sandwiched between both nozzle pieces 21, 22. The two nozzle pieces 21, 22 are both slim blocks made of metal (stainless steel) and are installed on the coating mechanism unit 10 in a state where the discharge outlet 29 faces downward. In the following description, the up-down direction is described with the installed state on the coating mechanism unit 10 as a reference.

The respective nozzle pieces 21, 22 have contact surfaces 21*b*, 22*b* (see FIG. 4) that face one another when the nozzle pieces 21, 22 are combined and include protruding portions 21*a*, 22*a* that protrude at an acute angle provided at lower end portions of the contact surfaces 21*b*, 22*b*. When the two nozzle pieces 21, 22 are combined, the discharge outlet 29 (see FIG. 3), described later, is formed by such protruding portions 21*a*, 22*a*.

Out of the nozzle pieces 21, 22, the first nozzle piece 21 is equipped with a manifold 26 that is an internally-formed space, a coating liquid supply opening 24 used to supply the coating liquid to the manifold 26, and a plurality of ventilation holes 31*a*, 31*b* that pass through to the manifold 26.

The coating liquid supply opening (coating liquid supply hole) 24 is a supply portion (supply channel) for the coating liquid. The coating liquid supply opening 24 has an upper end opening 24*a* formed in a center portion in the length direction X of the upper surface of the first nozzle piece 21 and a lower end opening 24*b* that is open to the manifold 26 side, and passes through to the manifold 26.

The manifold 26 is provided so as to cause the coating liquid supplied from the coating liquid supply opening 24 to spread out in the length direction (the length direction of the slit nozzle 20) X and extends in the length direction X of the slit nozzle 20. The manifold 26 has an opening 26*a* formed in the contact surface 21*b* of the first nozzle piece 21.

The ventilation holes 31*a*, 31*b* are used to exhaust gas inside the manifold 26 and each include a lower end opening that is open to the manifold 26 side and an upper end opening that is open to the outside of the slit nozzle 20. As one example, there are two ventilation holes 31*a*, 31*b* and such holes are formed on the respective sides in the length direction of the upper surface of the first nozzle piece 21 so as to be positioned on both sides of the coating liquid supply opening 24. Although it is possible to provide one ventilation hole or three or more ventilation holes, in view of the ability to exhaust gas, it is preferable to have an even number of holes to achieve line symmetry. Also, since an opening/closing means that is an opener/closer, such as a valve, for opening and closing the ventilation holes is a known device, detailed explanation thereof is omitted here.

The shim 23 is a thin plate-like material formed in a U shape and is equipped with a concave portion 23*a*. The shim 23 is assembled between the two nozzle pieces 21, 22 in a state where an open end of the concave portion 23*a* faces downward. By assembling the shim 23 so as to be interposed between the nozzle pieces 21, 22, a liquid channel space 28 is formed inside the slit nozzle 20 and a slit-shaped discharge outlet 29 is also formed at the bottom end of the slit nozzle 20. Accordingly, by adjusting the thickness of the shim 23, it is possible to adjust the slit width W (see FIG. 4) of the liquid channel space 28 and the discharge outlet 29. Also, by adjusting the length in the length direction X of the concave portion 23*a*, it is possible to adjust the length in the length direction X of the discharge outlet 29.

Also when the slit nozzle 20 has been produced by assembling the two nozzle pieces 21, 22 and the shim 23, the opening 26*a* of the manifold 26 will face the liquid channel space 28 (see FIG. 3) formed by the concave portion 23*a* of the shim 23. That is, an upper end portion of the liquid channel space 28 passes through to the manifold 26.

Accordingly, the coating liquid supplied from the coating liquid supply opening 24 flows into the manifold 26, is held inside the manifold and is caused to spread out in the length direction X. After this, the coating liquid flows into the liquid channel space 28 and is discharged via the liquid channel space 28 from the discharge outlet 29. Note that if the ventilation holes 31*a*, 31*b* are provided, it is easy for air inside the manifold 26 to escape to the outside, which promotes dispersion in the length direction X of the coating liquid inside the manifold 26.

Also, as shown in FIG. 1, the liquid coating apparatus 1 is equipped with a maintenance mechanism 40 for the slit nozzle 20 that is installed in front of (i.e., to the lower left in FIG. 1) the table 3 and a filling table 50 used when filling the slit nozzle 20 with the coating liquid.

The maintenance mechanism 40 is equipped with a sliding portion 48 that is capable of being pulled out in the width direction of the maintenance mechanism. When the sliding portion 48 is pulled out in the width direction (refer to the position shown with the dot-dot-dash line in FIG. 1), it becomes possible to remove or load the slit nozzle 20 from or onto the sliding portion 48. Once the slit nozzle 20 has been loaded onto the sliding portion 48 and the sliding portion 48 has then been returned to its original position, the slit nozzle 20 becomes placed on the maintenance mechanism 40. After this, when the coating mechanism unit 10 has moved to a position above the slit nozzle 20, it becomes possible to attach the slit nozzle 20 to the coating mechanism unit 10. In this way, the slit nozzle 20 can be attached to and detached from the liquid coating apparatus 1.

The filling table 50 is equipped with a filling bar (discharge outlet closing member) 51 that is detachably installed.

Figure 3:
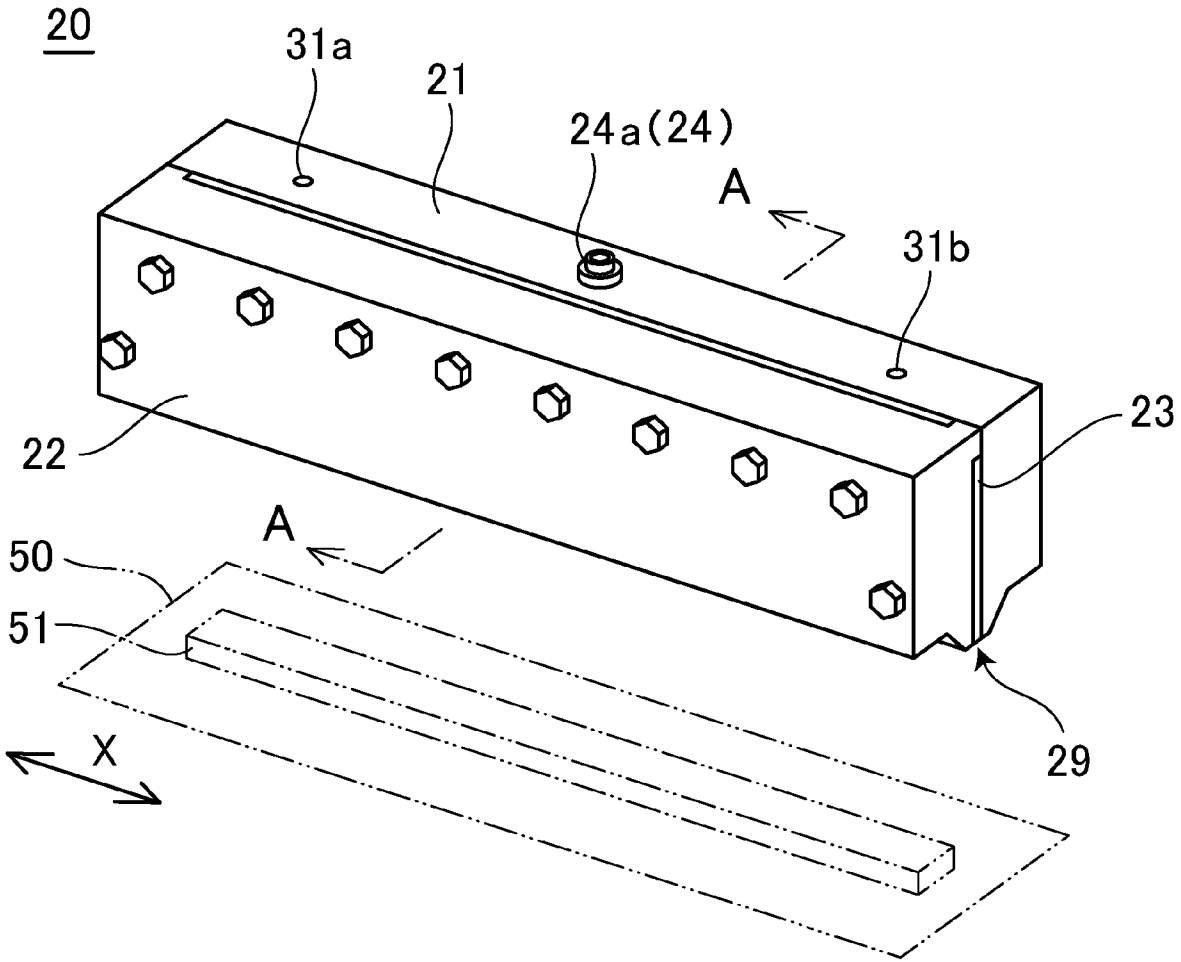
FIG. 3 is a perspective view showing the slit nozzle.
Figure 4:
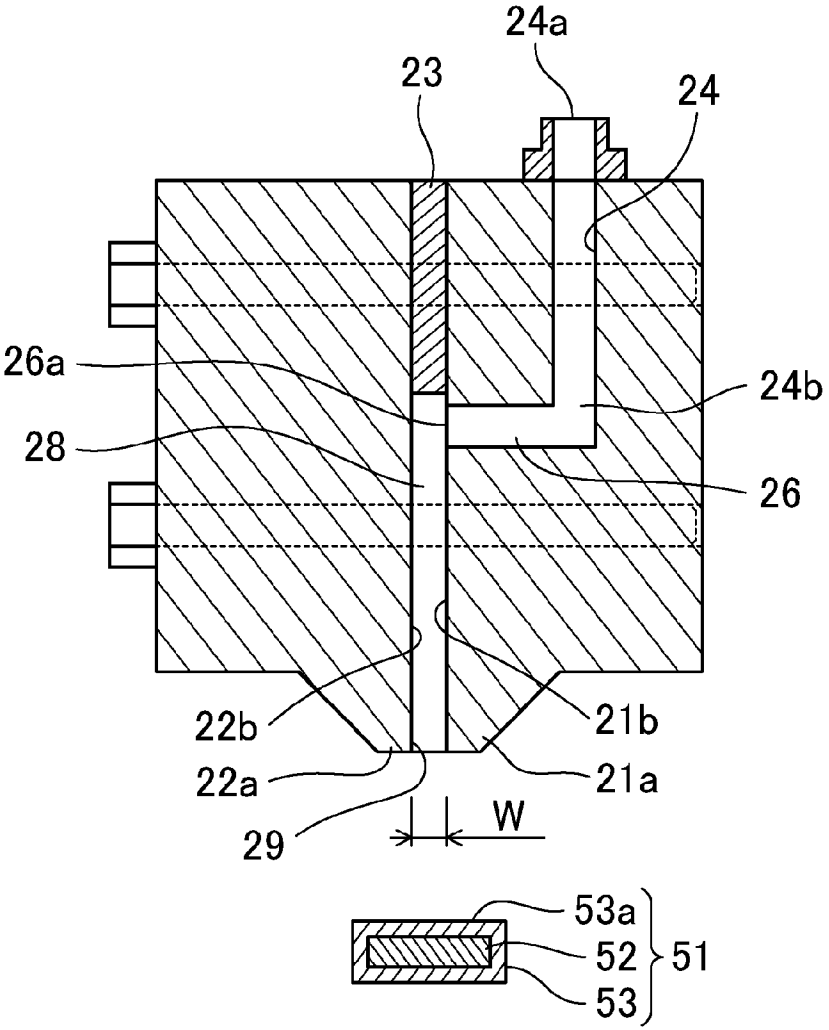
FIG. 4 is a cross-sectional view of the slit nozzle taken along a line A-A in FIG. 3.
Figure 5:
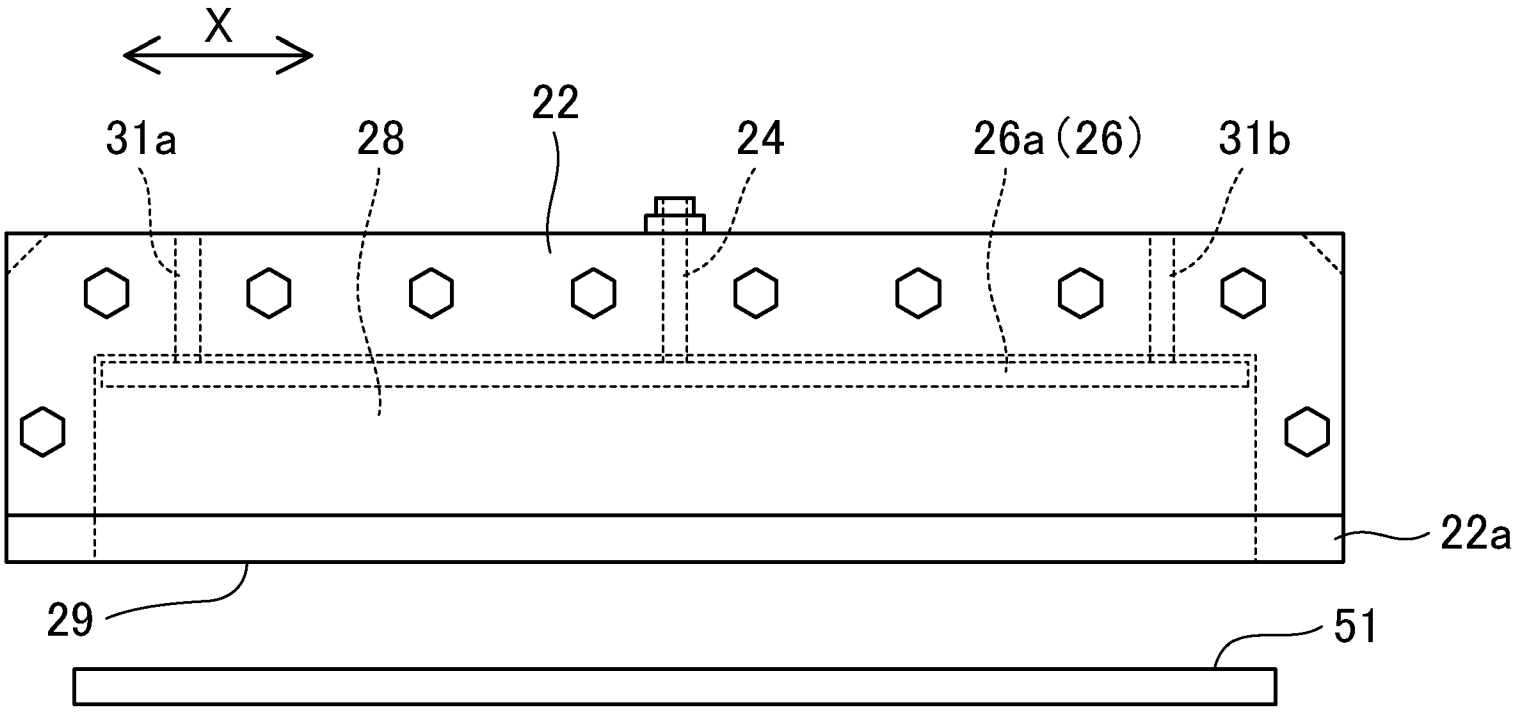
FIG. 5 is a front view showing the slit nozzle.

The filling bar 51 is used to close the discharge outlet of the slit nozzle 20 and as shown in FIGS. 3 and 4, is constructed of a bar-shaped core member (rigid body) 52 as a main body and a peripheral elastic member 53 that covers the core member 52. That is, the surface of the upper portion on the discharge outlet 29 side is constructed of an elastic material. Accordingly, when the discharge outlet 29 is closed using the filling bar 51, it is possible to reliably close the discharge outlet 29 using the filling bar 51. Since the filling bar 51 has the bar-shaped core member 52 inside, it is possible to reliably close the discharge outlet 29 without the filling bar 51 greatly deforming or bending when the discharge outlet 29 is closed by the filling bar 51. Since the elastic member 53 is specifically a rubber material, there is no damage to the discharge outlet 29 of the slit nozzle 20 when the discharge outlet 29 of the discharge outlet 29 is closed using the filling bar 51.

In this way, the filling bar 51 is used when filling the slit nozzle 20 with the coating liquid, and it is possible to regard the slit nozzle 20 and the filling bar 51 as a unit (slit nozzle unit) 15.

Figure 9:
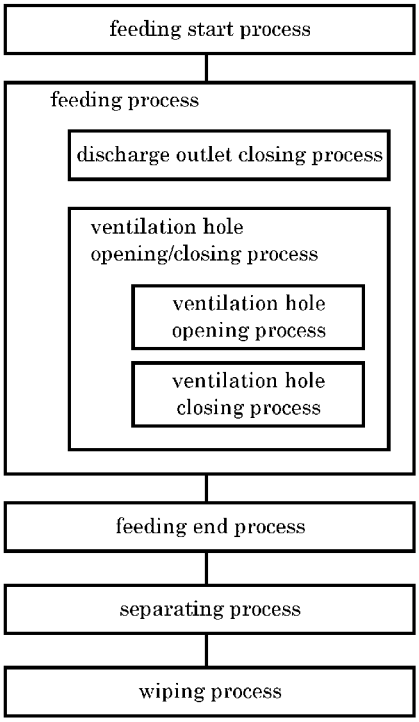
FIG. 9 is a flowchart showing the flow of operations in the coating liquid filling method.

Next, a coating liquid filling method that fills the slit nozzle of a liquid coating apparatus such as that described above with coating liquid will be described with reference to the flowchart shown in FIG. 9.

Here, the procedure of the coating liquid filling method will be described with a state where all of the ventilation holes are closed and the inside of the slit nozzle 20 has not been completely filled with the coating liquid as a starting point (see FIG. 6A).

Also, since a controller (see FIG. 8) for starting and ending the supplying of coating liquid, carrying out opening and closing the ventilation holes and/or a raising/lowering operation for moving the filling bar toward and away from the discharge outlet is a known control means, detailed description thereof is omitted here.

Filling with the coating liquid first starts with feeding the coating liquid into the slit nozzle 20 from the coating liquid supply opening 24 (feeding start process).

Figure 6:
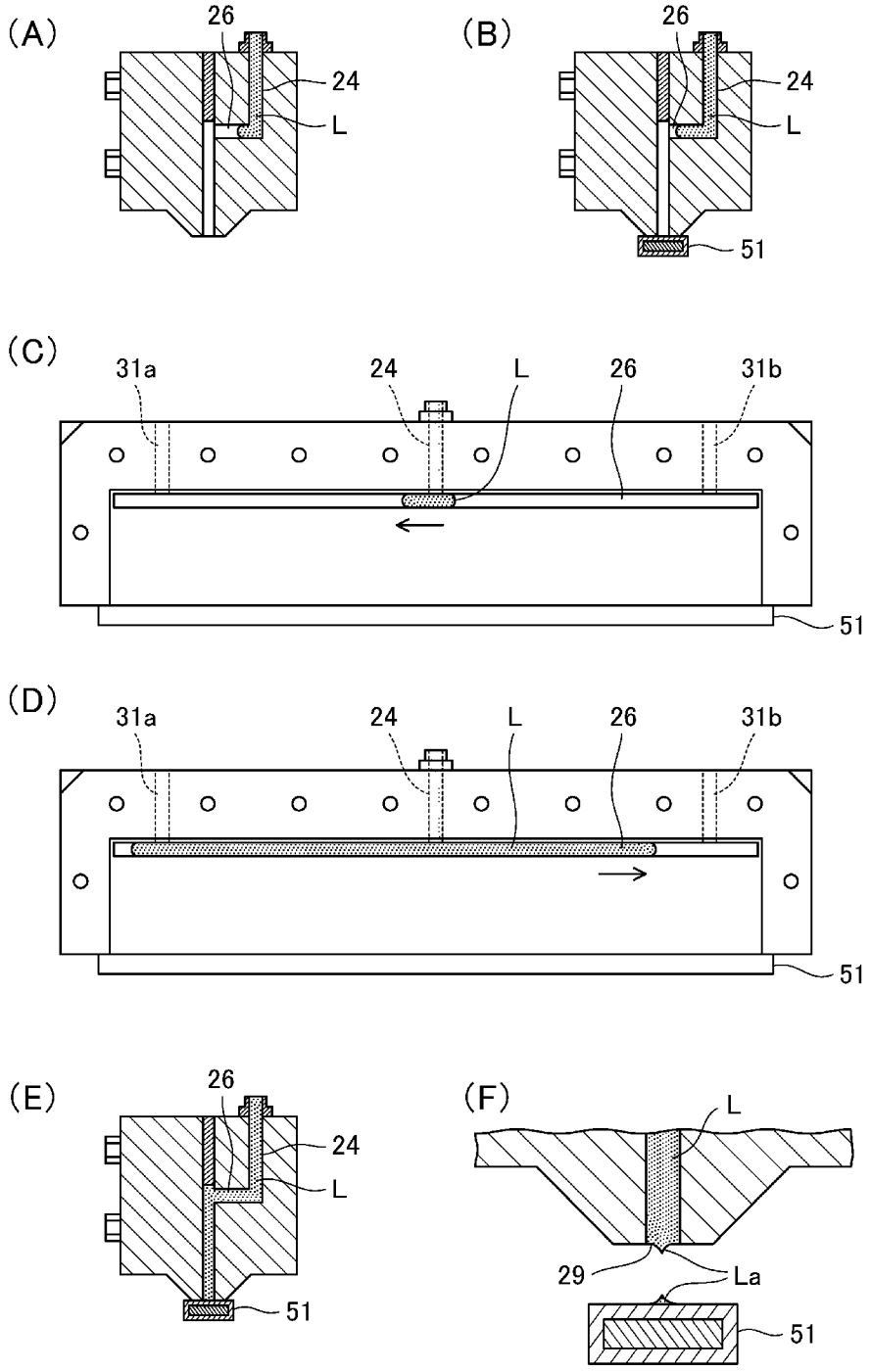
FIGS. 6A to 6F are schematic diagrams useful in explaining the coating liquid filling method.
Figure 7:
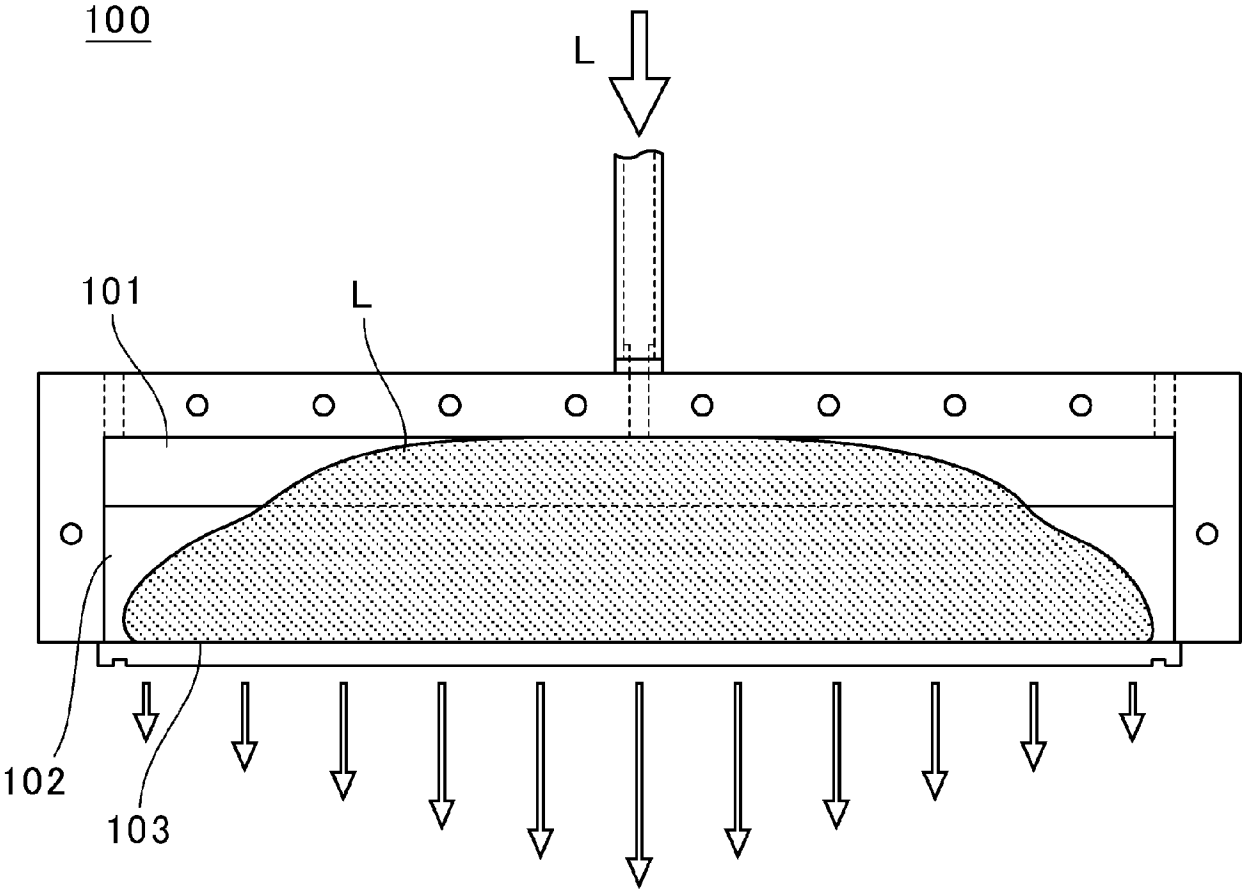
FIG. 7 is a schematic diagram useful in explaining a conventional filled state.

By doing so, the coating liquid flows from the coating liquid supply opening 24 inside the manifold 26 of the slit nozzle 20 (see FIG. 6A).

After this, during feeding, the discharge outlet 29 is closed by the filling bar 51 (discharge outlet closing process, see FIG. 6B). Note that the timing for closing the discharge outlet 29 is specifically before the coating liquid starts flowing inside the liquid channel space 28.

By using the filling bar 51 in this way to close the discharge outlet 29, the coating liquid L is prevented from flowing out of the discharge outlet 29 during filling.

If it is possible to prevent the coating liquid from flowing out of the discharge outlet 29, there will be no wasting of the coating liquid and dirtying of the periphery by coating liquid that has flowed out is prevented.

Also, during feeding, the ventilation holes are opened (ventilation hole opening process, see FIG. 6C).

Note that the timing for the initial ventilation hole opening process (the timing at which the ventilation hole opening/closing process starts) is before the coating liquid starts to flow into (fill) the liquid channel.

More specifically, the ventilation hole opening/closing process starts with opening one of the ventilation holes (the ventilation hole 31*a*) (ventilation hole opening process). Here, the ventilation hole 31*a* shown on the left in FIG. 2 is opened from the closed state. At this time, the other ventilation hole 31*b* is kept in the closed state (see FIG. 6C).

After this, once a predetermined period has elapsed, the one ventilation hole 31*a* that was opened in the preceding opening state is closed (i.e., a ventilation hole closing process is carried out) and together with this the other ventilation hole

31*b* is opened (ventilation hole opening process, see FIG. 6D). That is, the ventilation hole closing process for one ventilation hole 31*a* and the ventilation hole opening process for the other ventilation hole 31*b* are carried out together. In addition, when the predetermined period has elapsed, the first ventilation hole 31*a* is opened and together with this the ventilation hole 31*b* is closed.

In this way, in the ventilation hole opening/closing process, an opening/closing operation that alternately opens and closes is repeatedly carried out at intervals of a predetermined period. Putting this another way, in the ventilation hole opening/closing process, as one example a control means (not shown) is used to first control the opening of at least one of the ventilation holes and also control the closing of the remaining ventilation holes, and after that to successively control the opening and closing of the ventilation holes. After this, the ventilation hole opening/closing process is carried out at least until the gas inside the manifold 26 has been completely exhausted and the manifold 26 is filled with the coating liquid. The time for which the ventilation holes are open is appropriately set in accordance with the viscosity of the coating liquid and/or the number of ventilation holes.

In this way, some of the ventilation holes (for example, one of the ventilation holes 31*a*) is opened, the coating liquid is introduced into the manifold 26, and since air and bubbles inside the manifold 26 escape from the open ventilation holes to the outside, it is possible for the introduced coating liquid to efficiently flow and spread out inside the manifold 26 toward the ventilation hole(s) in the open state. A method of filling with coating liquid in the manner described above is especially effective when high pressure is required as the filling pressure and/or when a long time is required as the filling time, such as when filling with a highly viscose coating liquid.

Also, by successively changing which ventilation holes are open, it is possible to cause the coating liquid to flow efficiently within the entire manifold 26. In addition, by repeating the operation of changing the ventilation holes that are open whenever a predetermined period has elapsed, it is possible to cause the coating liquid to flow more reliably to all of the corners inside the manifold. Accordingly, during the ventilation hole opening/closing process, the number of times the ventilation holes are opened should preferably be at least twice for each ventilation hole.

Also, if the feeding of liquid into the slit nozzle 20 continues, some of the coating liquid that is held inside the manifold 26 will subsequently start to flow inside the liquid channel space 28. After that, the feeding of liquid further continues, the liquid channel space 28 becomes filled with the coating liquid, and after this, when the inside of the manifold 26 has become filled with the coating liquid, the feeding of liquid into the slit nozzle 20 ends (see FIG. 6E).

Once the feeding of liquid into the slit nozzle 20 has ended, the filling bar (discharge outlet closing member) 51 is separated from the discharge outlet 29 (separating process, see FIG. 6F).

After the end of filling, since the filling bar 51 that closes the discharge outlet 29 has contacted the coating liquid in the liquid channel space 28, when the filling bar 51 is separated from the discharge outlet 29, an extremely small amount of coating liquid La is pulled by the filling bar 51 and is brought out of the discharge outlet 29 (see FIG. 6F).

If no filling bar 51 were present, during filling, coating liquid that has reached the discharge outlet 29 would flow out from the discharge outlet. However, by using the filling bar 51 as in the present embodiment, such situation is prevented.

After the filling bar has been separated from the discharge outlet, a wiping process is carried out as necessary to wipe away extra coating liquid that adheres to the discharge outlet 29 of the slit nozzle 20 and thereby regulate the state of the front end of the coating liquid discharged from the discharge outlet 29.

Although the discharge outlet 29 is closed with the filling bar 51 during filling, there are cases where a small amount of the coating liquid flows out to the periphery of the discharge outlet 29 during filling. For this reason, the wiping process is carried out after filling with liquid and before the start of coating. By doing so, it is possible to scrape away liquid that has adhered to the discharge outlet 29. After this, coating is commenced.

As the member used for wiping, it is possible to use a member such as a so-called V-shaped rubber pad and a plate-like member that wipes the open end of the discharge outlet 29.

By doing so, when filling of the slit nozzle 20 with the coating liquid ends, it is possible to start the coating process that coats a predetermined width of the surface of the plate material 4, which is the surface of the processed object, with the coating liquid to form a coated layer.

Note that the coating liquid filling method, slit nozzle, discharge outlet closing member, and slit nozzle unit according to the present invention are not limited to the examples in the embodiments described above. It is possible to apply modifications without departing from the scope of the present invention, and such modifications are also included in the present invention.

As examples, as the timing for closing the discharge outlet 29 (discharge outlet closing process), it is possible to use timing before the coating liquid reaches the discharge outlet 29, timing before filling the manifold 26 with the coating liquid starts, the same timing as the start of the feeding process, and timing before the start of the feeding process.

Also, as the timing of the start of the ventilation hole opening process, it is possible to use timing before the start of filling the manifold 26 with the coating liquid, the same timing as the start of the feeding process, and timing before the start of the feeding process.

The number of ventilation holes to be opened in the ventilation hole opening process is also not limited to one. If a plurality of ventilation holes are provided, it is possible to bleed out the air inside the manifold 26 in a short time. So long as at least one ventilation hole is open during this process, the other ventilation holes may be open or may be closed.

In the ventilation hole opening/closing process, if the ventilation hole opening process for one ventilation hole and the ventilation hole closing process for another ventilation hole are carried out together, as the timing for carrying out both processes, aside from having such processes carried out at the same timing as in the embodiment described earlier, it is possible to carry out the ventilation hole closing process on some holes first and then carry out the ventilation hole opening process on other holes or to carry out the ventilation hole opening process on some holes first and then carry out the ventilation hole closing process on other holes.

The timing for ending the ventilation hole opening/closing process is also not limited to a filling completion time for filling the manifold 26 with the coating liquid that has been measured in advance, and it is possible to use a sensor that detects whether the coating liquid has reached the ventilation holes and to carry out the ventilation hole opening/closing process until such sensor reacts.

As the filling bar 51, as one example it is possible to use a bar whose upper portion on the discharge outlet 29 side is a flat upper surface 53*a*. It is also possible for the upper surface of the core member 52 positioned at the upper side of the filling bar 51 to be flat. Also, although the width of the upper surface of the filling bar 51 is wider than the slit width W of the discharge outlet 29 of the slit nozzle 20, it is also possible for the width of the upper surface of the core member 52 to be wider than the slit width W of the discharge outlet 29.

Also, as described earlier, if the discharge outlet 29 is closed using the filling bar 51, it is possible to prevent the coating liquid from leaking out from the discharge outlet 29 during a coating liquid filling operation. Accordingly, the discharge outlet closing process can be referred to as a process that moves the filling bar 51 from a separated position that is separated from the discharge outlet to a closed position that prevents the coating liquid from leaking out during filling. Also, as the discharge outlet closing process that closes the discharge outlet 29 using the filling bar 51 (see FIG. 6B), a method utilizing an operation of having the filling bar 51 press against (i.e., contact) the discharge outlet 29 and an operation of bringing the filling bar 51 close to the discharge outlet 29 can be given as examples.

Also, as described earlier, the inventions described in this application are favorable as a slit nozzle for coating with a highly viscous coating liquid and a coating liquid filling method that uses such slit nozzle.

More specifically, this is a bubble removing method that is effective in a case where the slit width is around 100 to 600 μm, the viscosity of the liquid is in a range of 1,000 to 5,000 cps and the coating liquid would reach the discharge outlet before spreading out inside the manifold.

What is claimed is:

1. A coating liquid filling method that fills an inside of a slit nozzle, which applies coating liquid with a predetermined width onto a surface of a processed object, with the coating liquid, wherein the slit nozzle includes a supply opening that is a supply portion for the coating liquid, a discharge outlet that is a discharge portion for the coating liquid, a manifold that is connected to the supply opening and holds the coating liquid inside the slit nozzle, a liquid channel that is connected to the manifold and supplies the coating liquid toward the discharge outlet of the slit nozzle, and a plurality of ventilation holes for exhausting gas from inside the manifold, the coating liquid filling method comprising:

a feeding process that feeds the coating liquid from the supply opening into the slit nozzle that has not been filled with the coating liquid;

a discharge outlet closing process that closes the discharge outlet;

a ventilation hole opening process that opens the plurality of ventilation holes a ventilation hole closing process that closes the plurality of ventilation holes the ventilation hole opening process and the ventilation hole closing process are carried out for each ventilation hole, The discharge outlet closing process, the ventilation hole opening process and the ventilation hole closing process are carried out during the feeding process, during a predetermined period of the feeding process, at least one ventilation hole is opened and the other ventilation holes are closed, once the predetermined period has elapsed, one of the closed ventilation holes is opened and the rest of the holes are closed, and during the feeding process, ventilation holes are alternately opened and closed.

2. The coating liquid filling method according to claim 1, wherein the feeding process is a process where filling of the manifold with the coating liquid is completed after filling the liquid channel with the coating liquid.

3. The coating liquid filling method according to claim 1, wherein the discharge outlet closing process is carried out before filling the liquid channel with the coating liquid is commenced.

4. The coating liquid filling method according to claim 1, further comprising:

a process that opens the discharge outlet that is in a closed state after an end of the feeding process; and a process that subsequently scrapes away coating liquid that has come out of the discharge outlet.

5. The coating liquid filling method according to claim 2, further comprising:

a process that opens the discharge outlet that is in a closed state after an end of the feeding process; and a process that subsequently scrapes away coating liquid that has come out of the discharge outlet.

6. The coating liquid filling method according to claim 1, wherein the discharge outlet closing process is a process that closes the discharge outlet by placing a discharge outlet closing member in contact with the discharge outlet, and the process that opens the discharge outlet that is in the closed state is a process that separates the discharge outlet closing member from the discharge outlet.

7. The coating liquid filling method according to claim 3, wherein the discharge outlet closing process is a process that closes the discharge outlet by placing a discharge outlet closing member in contact with the discharge outlet, and the process that opens the discharge outlet that is in the closed state is a process that separates the discharge outlet closing member from the discharge outlet.

8. The coating liquid filling method according to claim 6, wherein the discharge outlet closing member is constructed by covering a periphery of a core member, which is a main portion, with an elastic body.

9. The coating liquid filling method according to claim 7, wherein the discharge outlet closing member is constructed by covering a periphery of a core member, which is a main portion, with an elastic body.

* * * * *